US005935017A

United States Patent [19]

Weaver et al.

[11] Patent Number: 5,935,017

[45] **Date of Patent: *Aug. 10, 1999**

[54] GOLF CLUB SHAFT

[75] Inventors: Daniel L. Weaver, Carlsbad; Tsao Hsien Hwang, San Diego, both of Calif.

[73] Assignee: Cobra Golf Incorporated, Carlsbad, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/672,362

[22] Filed: Jun. 28, 1996

[51] Int. Cl.[6] ..... A63B 53/10; A63B 53/12

[52] U.S. Cl. ..... 473/319; 473/323

[58] Field of Search ..... 473/319, 323, 473/316, 317, 318, 320, 321, 322

[56] References Cited

U.S. PATENT DOCUMENTS

| | | |
|---|---|---|
| Re. 33,735 | 11/1991 | Rumble et al. . |
| D. 92,571 | 6/1934 | Barnhart . |
| 96,020 | 10/1869 | Lyons . |

(List continued on next page.)

FOREIGN PATENT DOCUMENTS

| | | |
|---|---|---|
| 2 667 794 A1 | 4/1992 | France . |
| 3-251269 | 11/1991 | Japan . |
| 9271548 | 10/1997 | Japan . |
| 24144 | 12/1911 | United Kingdom . |
| 256049 | 8/1926 | United Kingdom . |
| 360097 | 11/1931 | United Kingdom . |
| 371665 | 5/1932 | United Kingdom . |
| 404995 | 1/1934 | United Kingdom . |
| 439308 | 12/1935 | United Kingdom . |
| 447319 | 5/1936 | United Kingdom . |
| 447496 | 5/1936 | United Kingdom . |
| 447270 | 6/1936 | United Kingdom . |
| 447320 | 6/1936 | United Kingdom . |
| 465414 | 5/1937 | United Kingdom . |
| 482164 | 3/1938 | United Kingdom . |
| 483995 | 4/1938 | United Kingdom . |
| 518699 | 3/1940 | United Kingdom . |
| 876414 | 8/1961 | United Kingdom . |
| 1159714 | 7/1969 | United Kingdom . |
| 1201648 | 12/1970 | United Kingdom . |
| 1446444 | 8/1976 | United Kingdom . |
| 2 040 693 | 9/1980 | United Kingdom . |
| 2 053 004 | 2/1981 | United Kingdom . |
| 2 053 698 | 2/1981 | United Kingdom . |
| 2146906 | 5/1985 | United Kingdom . |
| 2 250 443 | 6/1992 | United Kingdom . |
| 2273662 | 6/1994 | United Kingdom . |
| 92/10244 | 6/1992 | WIPO . |

OTHER PUBLICATIONS

Links Profile, A Supplement to Links Magazine, "Fenwick Fine Tunes Shaft Technology, Industry Giants Keep an Eye on Iowa," Apr. 1996.

Stachura, Mike, "Shape Up Your Shafts," Golf Digest, Dec. 1997, pp. 88–95.

Advertisement: "New Clubs for 1938: True Temper Steel Shafts," Oct. 3, 1938, cover pg, and pp. 8–9.

*Primary Examiner*—Steven Wong
*Assistant Examiner*—Stephen L. Blau
*Attorney, Agent, or Firm*—Pennie & Edmonds LLP

[57] ABSTRACT

The present invention is directed towards a golf club shaft which comprises an upper section, a tip section, and a lower section therebetween. The tip section connects with a golf club head. The lower section includes a first tapered section and a hump section. The first tapered section is connected between the tip section and the hump section. The first tapered section increases in diameter in a direction away from the tip section. The hump section has a diameter that decreases in a direction away from the tip section, which is a reverse taper. The lower and upper sections are shaped so that the lower section is stiffer than the upper section.

14 Claims, 5 Drawing Sheets

U.S. PATENT DOCUMENTS

| | | | |
|---|---|---|---|
| D. 245,441 | 8/1977 | Middlestadt | D21/217 |
| D. 246,003 | 10/1977 | Shimada | D21/214 |
| D. 250,356 | 11/1978 | Kaugars | D21/221 |
| D. 263,330 | 3/1982 | Kaugars et al. | D21/221 |
| D. 315,386 | 3/1991 | Alonso | D21/219 |
| D. 327,309 | 6/1992 | Shigetoh | D21/221 |
| D. 351,643 | 10/1994 | Gubany . | |
| D. 352,755 | 11/1994 | Cornish, III | D21/214 |
| D. 385,608 | 10/1997 | Hoffmeyer . | |
| 391,994 | 10/1888 | Flotow et al. . | |
| 695,579 | 3/1902 | Parmele . | |
| 1,289,553 | 12/1918 | Sanders . | |
| 1,418,039 | 5/1922 | Tousey . | |
| 1,486,572 | 3/1924 | Forsyth | 473/322 |
| 1,565,069 | 12/1925 | Edwards . | |
| 1,565,070 | 12/1925 | Edwards . | |
| 1,604,696 | 10/1926 | Jordy . | |
| 1,639,864 | 8/1927 | Smith . | |
| 1,653,428 | 12/1927 | Brinkman . | |
| 1,670,530 | 5/1928 | Cowdery . | |
| 1,670,531 | 5/1928 | Cowdery . | |
| 1,688,473 | 10/1928 | Sippel . | |
| 1,713,812 | 5/1929 | Barnhart . | |
| 1,721,253 | 7/1929 | Loughead et al. . | |
| 1,765,709 | 6/1930 | Withington . | |
| 1,778,181 | 10/1930 | Brinkman | 72/75 |
| 1,781,116 | 11/1930 | Link et al. . | |
| 1,787,415 | 12/1930 | Washington . | |
| 1,796,274 | 3/1931 | Bryant . | |
| 1,840,406 | 1/1932 | McEvoy . | |
| 1,890,037 | 12/1932 | Johnson . | |
| 1,891,620 | 12/1932 | Crawford . | |
| 1,917,795 | 7/1933 | Fetter . | |
| 1,945,844 | 2/1934 | Young . | |
| 1,950,342 | 3/1934 | Meshel . | |
| 1,961,969 | 6/1934 | Heddon . | |
| 1,962,804 | 6/1934 | Cassady . | |
| 1,963,048 | 6/1934 | Cowdery . | |
| 1,974,271 | 9/1934 | Hackett . | |
| 1,974,389 | 9/1934 | Cowdery . | |
| 1,979,430 | 11/1934 | Wright . | |
| 1,980,031 | 11/1934 | Brading . | |
| 1,980,408 | 11/1934 | Jansky . | |
| 1,983,069 | 12/1934 | Cowdery . | |
| 1,983,074 | 12/1934 | Durell . | |
| 1,994,069 | 3/1935 | Fletcher . | |
| 1,997,853 | 4/1935 | Buhrke et al. . | |
| 2,001,643 | 5/1935 | Wilcox . | |
| 2,007,976 | 7/1935 | Kraeuter . | |
| 2,037,636 | 4/1936 | Lagerblade . | |
| 2,040,540 | 5/1936 | Young . | |
| 2,050,554 | 8/1936 | Barnhart | 473/323 |
| 2,066,442 | 1/1937 | Wright . | |
| 2,066,962 | 1/1937 | Cross . | |
| 2,086,275 | 7/1937 | Lemmon . | |
| 2,098,615 | 11/1937 | Cowdery . | |
| 2,113,826 | 4/1938 | Carpenter . | |
| 2,124,534 | 7/1938 | Barnhart . | |
| 2,130,395 | 9/1938 | Lard . | |
| 2,153,550 | 4/1939 | Cowdery . | |
| 2,153,880 | 4/1939 | Barnhart | 473/323 |
| 2,155,517 | 4/1939 | Turner . | |
| 2,196,742 | 4/1940 | Cowdery et al. . | |
| 2,220,852 | 11/1940 | Scott . | |
| 2,250,428 | 7/1941 | Vickery . | |
| 2,250,429 | 7/1941 | Vickery . | |
| 2,250,441 | 7/1941 | Vickery . | |
| 2,457,177 | 12/1948 | Reach . | |
| 2,464,850 | 3/1949 | Crawshaw . | |
| 2,700,547 | 1/1955 | Kraeling, Jr. . | |
| 2,934,345 | 4/1960 | Scott . | |
| 3,083,969 | 4/1963 | Bills, Jr. . | |
| 3,206,205 | 9/1965 | McLoughlin . | |
| 3,313,541 | 4/1967 | Benkoczy et al. . | |
| 3,519,270 | 7/1970 | Baymiller . | |
| 3,614,101 | 10/1971 | Hunter . | |
| 3,646,610 | 2/1972 | Jackson . | |
| 3,735,463 | 5/1973 | Merola | 29/897 |
| 3,764,137 | 10/1973 | Petro . | |
| 3,833,223 | 9/1974 | Shulkin . | |
| 3,963,236 | 6/1976 | Mann | 473/291 |
| 3,998,458 | 12/1976 | Inoue et al. . | |
| 4,000,896 | 1/1977 | Lauraitis . | |
| 4,082,277 | 4/1978 | Van Auken et al. | 473/320 |
| 4,097,626 | 6/1978 | Tennent . | |
| 4,131,701 | 12/1978 | VanAuken . | |
| 4,135,035 | 1/1979 | Branen et al. . | |
| 4,157,181 | 6/1979 | Cecka . | |
| 4,165,874 | 8/1979 | Lezatte et al. . | |
| 4,169,595 | 10/1979 | Kaugars . | |
| 4,205,845 | 6/1980 | Kanne | 473/323 |
| 4,236,386 | 12/1980 | Yates et al. . | |
| 4,240,631 | 12/1980 | MacDougall . | |
| 4,288,075 | 9/1981 | Kaugars et al. . | |
| 4,319,750 | 3/1982 | Roy | 473/320 |
| 4,330,126 | 5/1982 | Rumble . | |
| 4,415,156 | 11/1983 | Jorgensen . | |
| 4,431,187 | 2/1984 | Rumble et al. . | |
| 4,558,863 | 12/1985 | Hass et al. . | |
| 4,591,157 | 5/1986 | Parente et al. | 473/322 |
| 4,725,060 | 2/1988 | Iwanaga . | |
| 4,836,545 | 6/1989 | Pompa | 473/320 |
| 4,961,576 | 10/1990 | Meredith . | |
| 5,004,236 | 4/1991 | Kameshima . | |
| 5,018,735 | 5/1991 | Meredith et al. . | |
| 5,022,652 | 6/1991 | Fenton | 473/323 |
| 5,074,555 | 12/1991 | Meredith . | |
| 5,083,780 | 1/1992 | Walton et al. . | |
| 5,093,162 | 3/1992 | Fenton et al. . | |
| 5,143,374 | 9/1992 | Shibasaki . | |
| 5,156,396 | 10/1992 | Akatsuka et al. . | |
| 5,251,896 | 10/1993 | Gerlach . | |
| 5,259,614 | 11/1993 | Greer . | |
| 5,265,872 | 11/1993 | Tennent et al. . | |
| 5,277,423 | 1/1994 | Artus | 473/319 |
| 5,294,119 | 3/1994 | Vincent et al. . | |
| 5,297,791 | 3/1994 | Negishi . | |
| 5,308,062 | 5/1994 | Hogan | 473/319 |
| 5,316,299 | 5/1994 | Feche et al. . | |
| 5,316,300 | 5/1994 | Simmons . | |
| 5,324,032 | 6/1994 | Minami . | |
| 5,351,958 | 10/1994 | Helmstetter . | |
| 5,385,767 | 1/1995 | Noguchi . | |
| 5,413,338 | 5/1995 | Kawamatsu | 473/319 |
| 5,427,373 | 6/1995 | Kusumuto . | |
| 5,437,450 | 8/1995 | Akatsuka et al. . | |
| 5,439,219 | 8/1995 | Vincent . | |
| 5,467,984 | 11/1995 | Veux et al. . | |
| 5,496,028 | 3/1996 | Chien . | |
| 5,505,446 | 4/1996 | Whitaker . | |
| 5,511,780 | 4/1996 | Vadersen | 473/309 |
| 5,551,691 | 9/1996 | Harada et al. . | |
| 5,573,467 | 11/1996 | Chou et al. . | |
| 5,575,473 | 11/1996 | Turner | 473/298 |
| 5,599,242 | 2/1997 | Solviche et al. . | |
| 5,620,380 | 4/1997 | Tennent et al. . | |
| 5,632,692 | 5/1997 | Lebovici . | |
| 5,634,860 | 6/1997 | McIntosh et al. . | |
| 5,634,861 | 6/1997 | Yamamoto et al. . | |
| 5,665,010 | 9/1997 | Mori | 473/316 |
| 5,685,781 | 11/1997 | Pedersen et al. | 473/318 |
| 5,735,753 | 4/1998 | Hoffmeyer . | |

GOLF CLUB SHAFT

BACKGROUND OF THE INVENTION

This invention relates generally to a golf club shaft, and in particular to a golf club shaft that has improved playing characteristics.

A golf club shaft may normally be made of different types of material, such as wood, metal or a composite material, and be tapered to have a smaller diameter lower portion with a tip end that is connected to a golf club head, and a larger diameter upper grip or butt portion where a player grips the shaft.

Golf club shafts have several physical characteristics that determine the playing characteristics of the shaft, including a flex point and stiffness. The flex point of a golf club shaft is the point at which the shaft has its maximum deflection when flexed. It may be determined by clamping both ends of the shaft so that neither end can move, and then flexing the shaft. The location where the greatest deflection of the shaft occurs is known as the flex point, which is also known as the kick point. The location of the flex point determines the trajectory that a golf ball may have when struck by the golf club as well as the speed of the golf ball. Typically, beginning players desire a higher trajectory so that they want a golf club shaft with a lower kick point. Professional players, who have sufficient strength and skill to drive a golf ball without added trajectory, want a lower flight and a golf club shaft with a higher flex point. The flex point depends on the structure and material of the shaft. For example, a shaft with a constant diameter will have a flex point located at its midpoint, whereas a tapered shaft will have its flex point located more towards the small end of the shaft. The flex point may also be changed by changing the material of the shaft.

The stiffness of a shaft also affects the playing characteristics of the shaft. The stiffness of the shaft depends on the diameter of the shaft, the material from which it is made and to a lesser degree the wall thickness. For example, a constant diameter shaft would have a constant stiffness, but a tapered shaft would have different stiffness at different parts of the shaft. Typically, a professional player that may swing a golf club with a velocity of about 100 mph wants a stiffer shaft because a more flexible shaft bends too much. A beginning player needs a more flexible shaft because the beginning player cannot swing the golf club with as much velocity as a professional player.

Typical golf club shafts may have a taper that is constant from the upper grip or butt end down to the lower tip end. Thus, the diameter of the shaft is constantly increasing to a maximum diameter at the upper grip end of the shaft. This conventional constant taper golf club shaft is easy to fabricate. However, due to the constant taper, the shaft has a smaller diameter tip end that may be less stable and more flexible than the thicker upper portions such as the grip end section. The less stable tip end has a number of drawbacks that affect the overall playing characteristics of a golf club. First, since the tip end is more flexible, it has less rigidity and the tip end of the shaft tends to twist and bend when loads are exerted on it. In particular, when a golf club is swung, the torque forces acting on the heavy club head tend to twist the tip end of the shaft causing the club head to unsquare and strike the golf ball at an angle, leading to inaccurate golf shots. Second, as the golf club head strikes the golf ball, a force is exerted on the golf club head by the golf ball, which also may tend to bend the tip end of the shaft and unsquare the club head. Third, the more flexible shaft cannot support the weight of a golf club head and the head tends to droop which in turn causes the shaft to bend. Twisting and bending causes the club head face to strike the golf ball at an angle which leads to inaccurate golf shots. Thus, a conventional constant taper shaft may have a tip end that is not rigid enough to prevent the twisting and bending that may occur. Thus, this conventional club may have unsatisfactory playing characteristics.

To improve the playing characteristics of a golf club, some conventional golf club shafts have substituted various stronger composite materials in the tip end of the shaft in an effort to build up the sidewalls of the tip end. These composite materials, however, may be very expensive or difficult to work with. In addition, these composite materials may have only limited benefits because the tip end has a small diameter so that only a small amount of composite material may be added to the tip end of the shaft. Thus, using additional composite materials does not significantly improve the playing characteristics of a golf club.

Other conventional shafts may attempt to improve the playing characteristics of a golf club and the stability of the tip end of the shaft by increasing the overall diameter of the entire shaft or by employing shafts with varying diameters or tapers. An oversized diameter shaft may have a stiffer, more stable tip end, but it also has an oversized grip section that may be too large for most players. In addition, the oversized diameter shaft may be too heavy or too stiff so that it does not feel good to most golf players. Other conventional shafts may have non-constant tapers that improve the playing characteristics of the golf club, but these non-constant tapered shafts are expensive and are also more difficult to manufacture. These non-constant taper shafts may also be too heavy.

The stability of the golf club head is critical to the playing characteristics of a golf club and the stability is strongly influenced by the shaft characteristics. Varying the relationship between the lower tip end of the shaft and the upper grip section has not proved successful in the past. As the lower tip end may be stabilized to improve the strength of the tip end, the upper grip end must also be altered in order to have a golf club shaft that feels good to the golf player, and this combination has been difficult to achieve. None of the conventional golf club shafts have been able to achieve a stable tip section as well as a grip section that feels good to a golf player.

Thus, there is a need for a golf club shaft which avoids these and other problems of known devices, and it is to this end that the present invention is directed.

SUMMARY OF THE INVENTION

The invention provides a golf club shaft with improved playing characteristics that may have a more stable, lower section and a better feeling, more flexible, upper section, and which affords better accuracy than conventional clubs. This combination of a stable lower section and a more flexible upper section may be obtained by using alternate geometries at the lower section and at the upper section of the shaft. The improved stability and playing characteristics of the golf club shaft in accordance with the invention enables it to produce more accurate golf shots with less hooks and slices, and also produces longer golf shots.

The invention also provides a golf club shaft with both the desired stability in the tip section of the shaft to produce straighter, longer golf shots, and a more flexible upper section to obtain the desired flex point, and the necessary varying stiffness of the grip end of the shaft for a variety of different golf players.

In accordance with one aspect of the invention, a golf club shaft is provided that may have an upper section and a lower section. The upper section includes a grip section that is formed to be gripped by a golf player, and the upper section is shaped to have a predetermined stiffness. The lower section is connected to a tip section formed to receive a golf club head, and is connected to the upper section. The lower section may be located in a lower third of the shaft, and have a shape such that the stiffness of the lower section is greater than the predetermined stiffness of the upper section.

In accordance with another aspect, a golf club shaft is provided that may have a lower shaft section having an upper end and a diameter that tapers from the upper end of the tapered section of the shaft having a first diameter value toward the tip end of the shaft having a second diameter value. The shaft may also have an upper shaft section extending from the butt end of the shaft towards the lower section, the upper shaft section having a second diameter that tapers from the butt end of the shaft having a third diameter value to the lower section of the shaft having a fourth diameter value. A transition region is also included in the lower section. It has a reverse taper connecting the lower section to the upper section. The taper per unit length of the lower section is greater than the taper per unit length of the upper section so that the rate of stiffness increase of the lower section, as measured toward the butt end of the shaft, is greater than the rate of stiffness increase of the upper section, as measured toward the butt end of the shaft.

DETAILED DESCRIPTION OF A PREFERRED EMBODIMENT

The invention is particularly applicable to a golf club shaft, and in particular, to a composite golf club shaft having sections with varying tapers and diameters. It is in this context that the invention will be described. It will be appreciated, however, that a shaft in accordance with the invention has greater utility.

Figure 1:
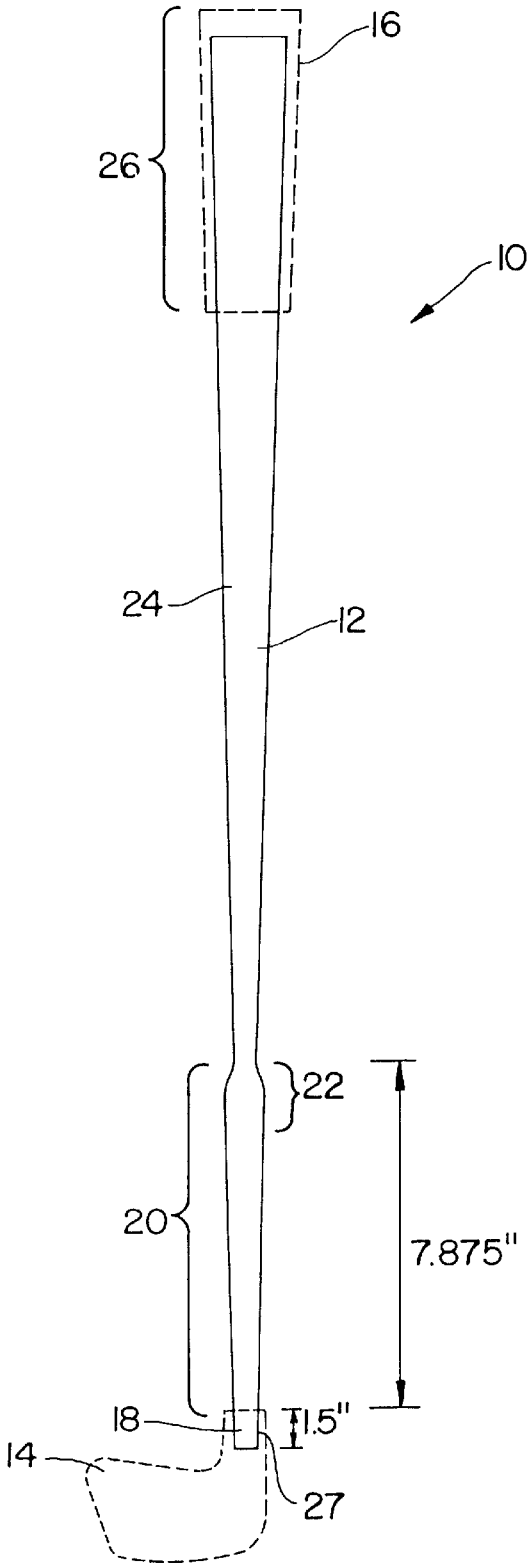
FIG. 1 is a side view of a golf club with a golf club shaft in accordance with the invention.

FIG. 1 is a side view of a golf club 10 that may have a shaft 12 in accordance with the invention. The shaft 12 may preferably be a composite material, but may also be steel. The golf club 10 may also have a club head 14 and a grip 16. The club head 14 may be attached to a tip section 18 of the shaft. The tip section may be connected to a lower section 20 that may have a hump section 22 in it, as described below in more detail. The lower section 20 may in turn be connected to an upper section 24 that may have the grip 16 connected to an upper grip or butt end 26 of the shaft. As shown in this example, the tip section of this shaft may have a length sufficient to be received in a hosel 27 of the golf club head 14. The tip section may be about 1.5 inches long, and the lower section may be about 7.875 inches long, for example. The length of the lower section and the location of the hump section may vary depending on the desired stiffness of the shaft and the desired location of the shaft flex point, as described in more detail below. Generally, the lower section and the hump section provide increased stiffness to the lower section of the shaft, as described in more detail below, which reduces the tendency of the shaft to twist, provides better control of the club head, and increases the accuracy of a golf shot. In addition, the hump section may also have a reverse taper or transition section of decreasing diameter, as described below, so that the diameter and taper of the upper section 24 may be approximately similar to a conventional shaft. It is desirable that the upper section have a similar diameter and taper as conventional shafts so that the upper section is about as stiff as a conventional shaft and the flex point of the shaft may be located lower on the shaft. If the transition region was longer, that the flex point would be located higher on the shaft, which is undesirable. The detailed structure of the lower section, and in particular the hump section will now be described.

Figure 2:
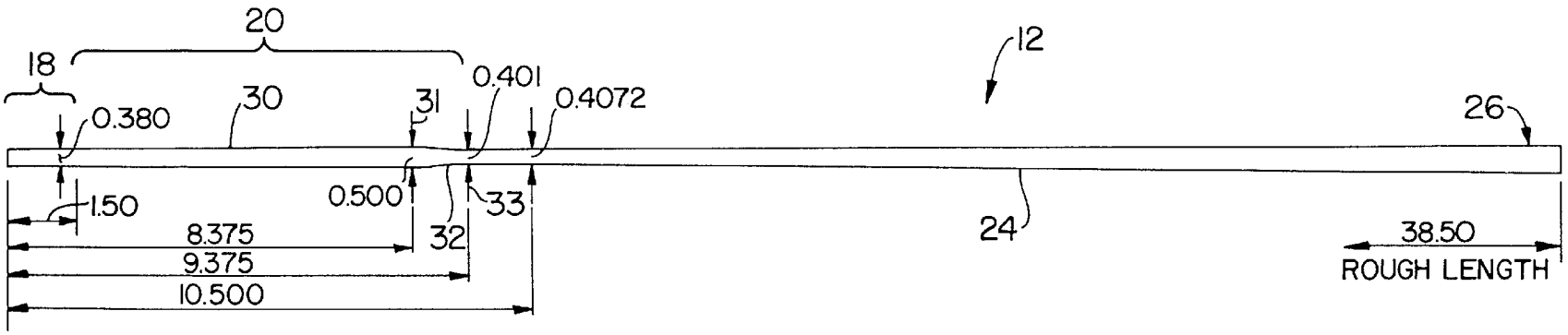
FIG. 2 is an side view of the golf club shaft of FIG. 1.
Figure 3:
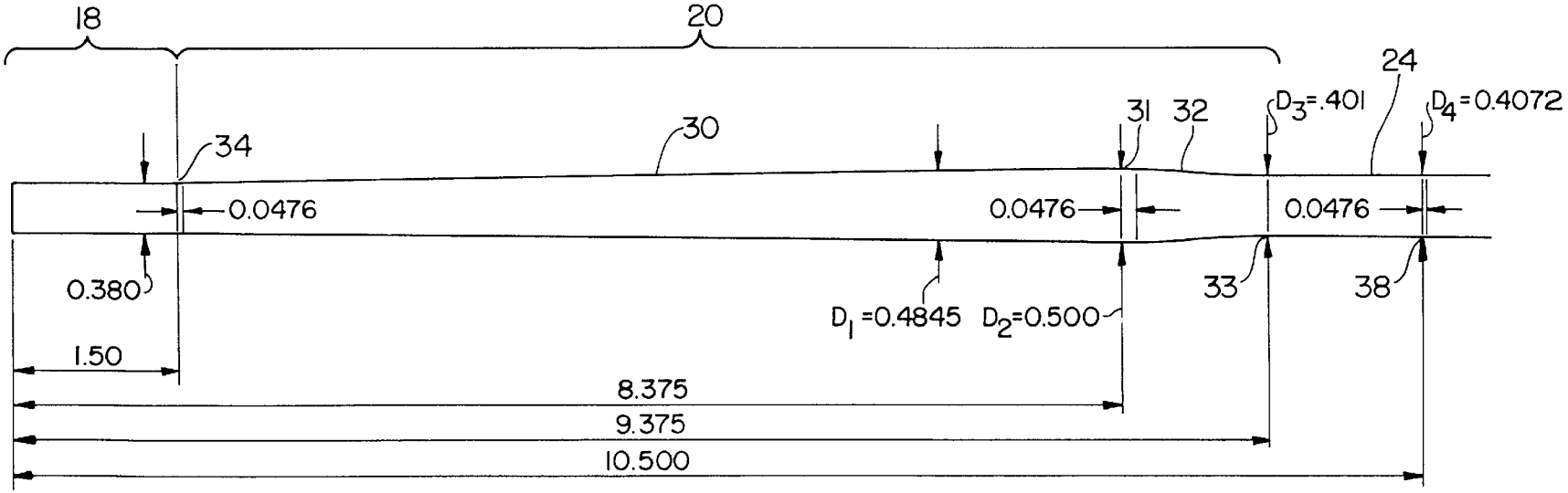
FIG. 3 is an expanded side view of the lower section of the shaft of FIG. 2.

FIGS. 2 and 3 are side views of the shaft 12 which indicate preferred dimensions for one embodiment of the invention. The shaft may have the tip section 18 that may be 1.5 inches long, for example, for receiving the hosel 27 of the golf club head 14, and may have a constant diameter of approximately 0.380 inches. The lower section 20 of the shaft may have a first tapered section 30 that may have a preferred diameter that tapers from a preferred diameter of approximately 0.500 inches at an upper end 31 of the first tapered section to approximately 0.380 inches at the connection with the tip section. The tip section may be connected to the first tapered section by a first transition region 34 that may be 0.0476 inches long. In the first transition region, the constant diameter of the tip section changes to the increasing diameter of the first tapered section in a relatively small area.

The upper end 31 of the first tapered section is connected over a short length, such as 0.0476 inches for example, to a second tapered section 32 that may have a reverse taper or a varying diameter that may taper from a diameter of approximately 0.500 inches at the upper end 31 of the first tapered section to a diameter of approximately 0.401 inches at an upper end 33 of the second tapered section. At the upper end 33 of the second section, the decreasing diameter of the second tapered section changes to a slowly increasing diameter of the upper section 24 over a length of 0.0476 inches. The second tapered section may then be connected to the upper section 24 that may have a diameter that tapers from a diameter of approximately 0.0472 inches at a point that may be 10.5 inches from the tip end of the shaft to diameter of approximately 0.401 inches at the upper end 33 of the second tapered section. The diameter of the butt end 26 of the shaft may be approximately 0.600 inches.

As shown, the length of the second tapered section 32, where the diameter decreases, is short as compared to the length of the first tapered section 30 and the length of the upper section 24. The second tapered section provides a rapid transition between the oversized diameter lower section and the more slowly tapered upper section. This transition may be as short as possible so that the transition does not adversely affect the playing characteristics of the shaft. For example, a longer length second tapered section leads to a longer section of the shaft that has a larger diameter that is stiffer which may move the flex point to an unacceptable location.

As shown, in this example, the tip section may be 1.5 inches long, the first tapered section may be 6.875 inches long, the second tapered section may be 1 inch long, and of the upper section may be 29.125 inches long. The length and diameters of each of these sections of the shaft may vary depending on the particular characteristics of the golf club shaft. In addition, the length of the sections and the shaft may be longer for a 3 iron than for a 9 iron. In particular, as the speed of the player's swing increases, the flex point of the shaft should be higher up the shaft so that the golf ball has a lower trajectory through the air.

The advantage of the invention in providing a greater taper rate in the lower section of the shaft is that greater stiffness and stability can be obtained for the tip end, while allowing adjustment of the flex point. The flex point may be easily adjusted since the upper section of the shaft is more flexible than conventional shafts. To adjust the flex point, the location of the hump section may be moved. For example, for a men's shaft, the hump section may be located at about 8.5 inches from the tip end of the shaft. A senior's shaft may have a hump section that is located at about 7.5 inches from the tip end to move the flex point lower and increase the loft of the golf ball. A woman's shaft may have a hump section that is located at 6.5 inches from the tip end to lower the flex point more and increase the loft of the golf ball.

The lower section 20, due to the rapid taper, has a larger diameter so that the lower section is stiffer. The stiffer lower section tends to reduce any twisting or bending of the shaft so that the club head strikes the golf ball squarely, leading to more accurate golf shots, as described below. In addition, however, the short second tapered section provides an upper section 24 that may be approximately the same diameter and taper of a conventional shaft. Thus, the upper section is as flexible as conventional shafts so that the player feels comfortable with the shaft. As described above, the flexible upper section also provides the flex point at a desired location on the shaft. In summary, the shaft in accordance with the invention has excellent playing characteristics due to the stiffer lower section as well as a desired flex point location and stiffness due to the more flexible upper section.

The shaft may be manufactured by using a mandrel and laying a plurality of strips of a composite material, such as carbon fiber, onto the mandrel until the desired diameters are obtained. The areas of the shaft with larger diameters may have more strips of composite materials. In addition, to further strengthen the shaft, the strips may be laid onto the mandrel in such a way that the fibers within the strips are located at 45 degree and 90 degree angles with respect to the other fibers. This angular orientation of the fibers increases the strength of the shaft. Then, once all of the strips have been laid up on the mandrel, the entire mandrel and shaft are heated and cured in an autoclave to set the composite materials. Then, the cured shaft is ground or sanded down to a finished shaft.

The shaft shown in FIGS. 1–3 is a preferred embodiment of the invention, but the invention is not limited to any particular diameter or any particular length of any particular section. Rather, the rate of increase in the diameter of the lower section, the taper, is related to rate of increase in the diameter of the upper section, the taper, by the following equation:

$$\frac{(D2 - D1)}{(D4 - D3)} \geq 2 \qquad (1)$$

where D1 is the diameter of the lower section 20 some distance $l_1$ below the hump section 22, as located at the supper end 31 of the first tapered section, D2 is the diameter of the lower section at the upper end 31 of the lower section, D3 is the diameter of the upper section 24 at the bottom 33 of the second tapered section 32, and D4 is the diameter of the upper section 24 at a distance $l_2$ above the bottom 33 of the upper section. This relationship is valid if the distance $l_1$ is equal to the distance $l_2$. The locations at which the diameters D1, D2, D3 and D4 are measured, are shown, for example, in FIG. 3. Thus, for the shaft of FIGS. 2 and 3, the relationship holds since (D2-D1) is equal to 0.0155 and (D4-D3) is equal to 0.0062 so that the ratio of these two numbers is about 2.5. Any shaft with a ratio of greater than or equal to two may be within the scope of the invention. The performance and characteristics of a golf club shaft will now be described.

Figure 4:
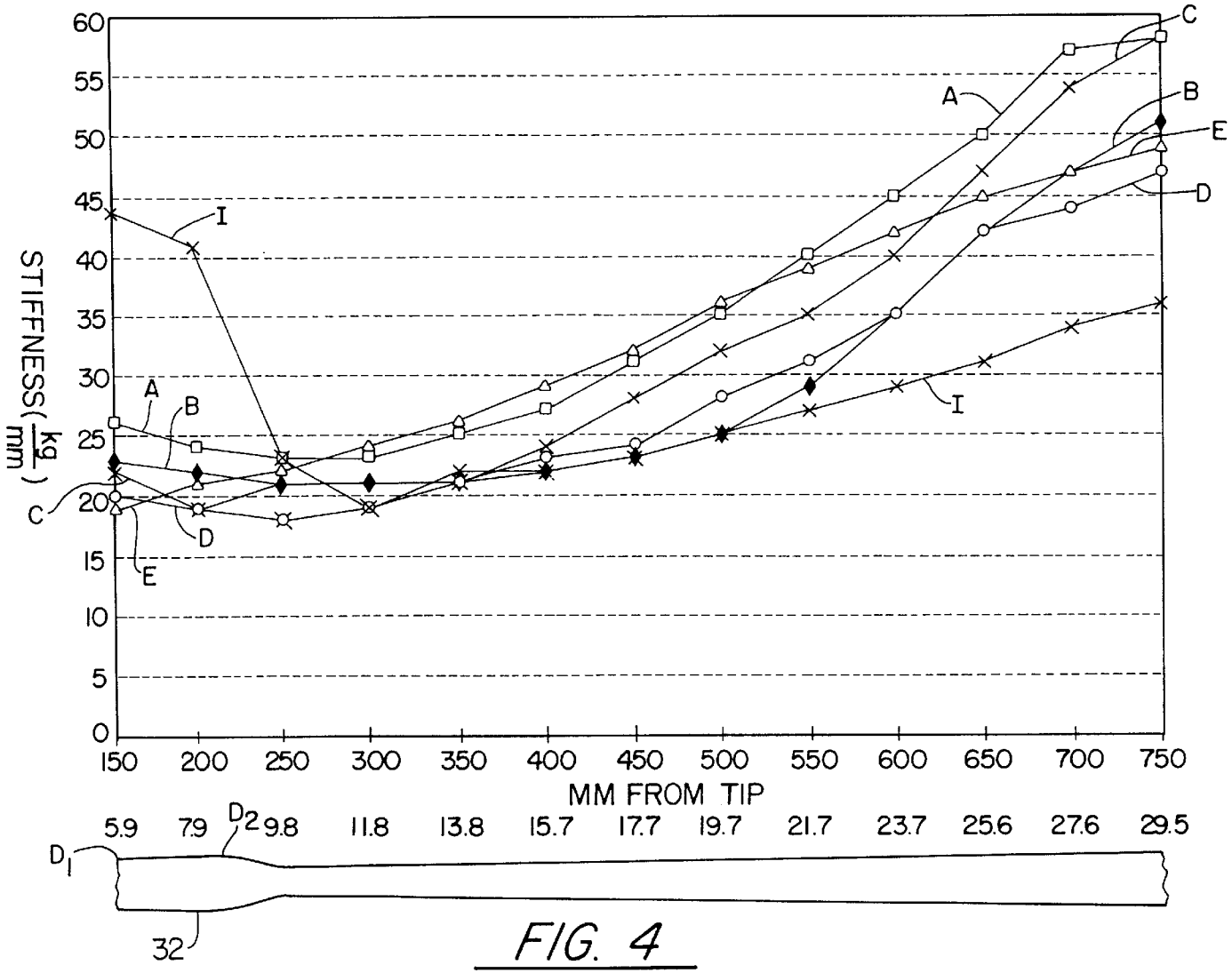
FIG. 4 is a chart comparing the stiffness of various conventional shafts at various points on the shaft to the golf club shaft in accordance with the invention.

FIG. 4 is a chart showing the variations in stiffness with length of various conventional golf club shafts, A–E, and of the golf club shaft, I, in accordance with the invention, for corresponding golf clubs. The profile of the shaft in accordance with the invention is shown below the chart to illustrate the correspondence between diameters and stiffness. As shown, the stiffness of a golf club shaft in accordance with the invention, within the first tapered region 30 from about 6 inches (150 mm) from the tip, where diameter D1 is located, to about 8 inches (200 mm) from the tip, where diameter D2 is located, is almost twice as stiff as the conventional shafts. Then, in the second tapered section 32 where the diameter of the shaft decreases, the stiffness of the shaft, I, quickly drops and is approximately equal to the conventional shafts. As described above, the short, second tapered section of the shaft rapidly reduces the stiffness of the shaft so that a low flex point may be obtained. For the upper section 24 of the shaft, for example, where diameters D3 and D4 are located, the shaft is equally as stiff or slightly less stiff than conventional shafts. The shaft may also be as much as half as stiff as one of the conventional shafts at the grip end. The more flexible upper section provides better feel to a golf player, and permits the flex point of the shaft to be located at appropriate locations on the shaft.

To illustrate the improved playing characteristics and control afforded by the shaft in accordance with invention, tests were conducted in which a large number of players hit golf balls with several different golf clubs, including the golf club with the shaft in accordance with the invention. The players first hit several golf balls with a conventional golf club and the accuracy of those shots was measured. Then those same players hit several golf balls with a golf club having the shaft in accordance with the invention, and the accuracy of those shots was also measured.

Figure 5:
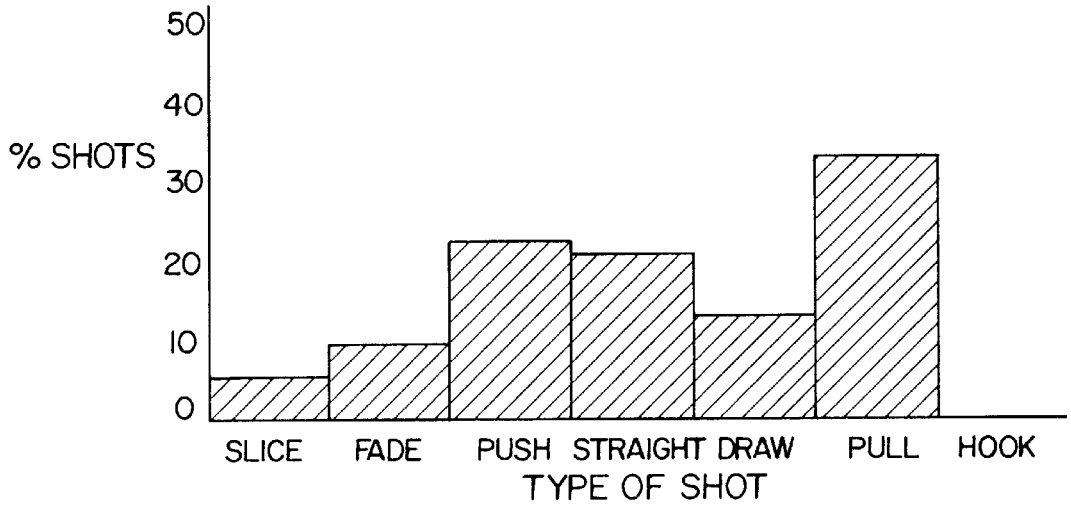
FIG. 5 (PRIOR ART)
FIG. 5 is a chart showing the golf shot profile for a conventional golf club shaft.
Figure 6:
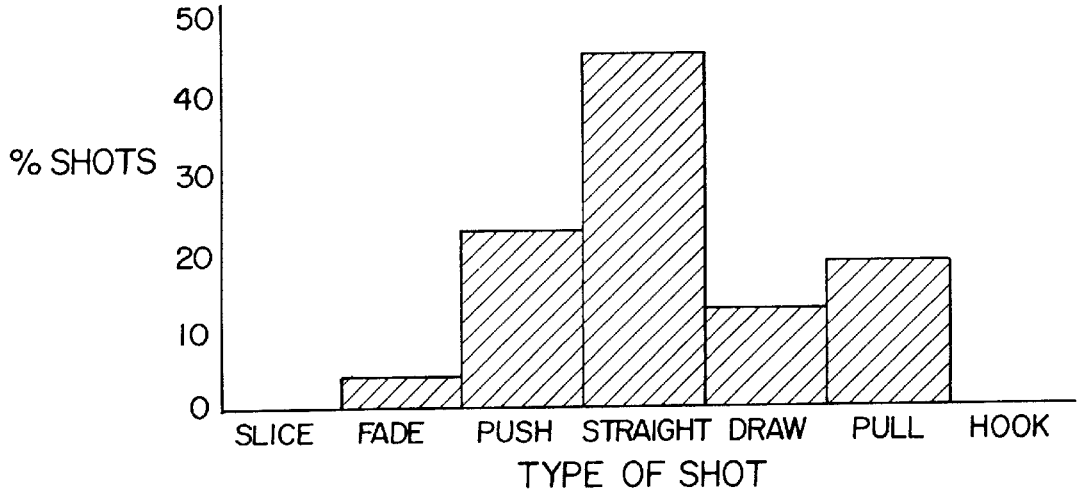
FIG. 6 is a chart showing the golf shot profile for a golf club shaft in accordance with the invention.

FIGS. 5 and 6 show the accuracy of shots using the conventional shafts and the accuracy of using the golf club with a shaft in accordance with the invention, respectively. The conventional shaft had about 5% slice shots, 9% fade shots, and 22% push shots. In addition, the conventional shaft also had about 12% draw shots, and 32% pull shots. This combines for a total of 80% of the shots that were not straight and only 20% of the shots that were in fact straight and accurate. By contrast, a golf club shaft in accordance with the invention has about 45% straight shots, and only about 55% inaccurate shots. This dramatic increase in the accuracy of shots with the shaft may be attributable to the stiffer tip section of the shaft which prevents unwanted twisting of the shaft.

While the foregoing has been with reference to a particular embodiment of the invention, it will be appreciated by those skilled in the art that changes in this embodiment may be made without departing from the principles and spirit of the invention, the scope of which is defined by the appended claims.

We claim:

1. A golf club shaft having a tip end and a butt end, comprising:

a tip section including said tip end for receiving a golf club head;

a lower section having an upper end and a first tapered section tapering in a direction toward said tip section at a substantially constant first taper per unit length from an upper end of said first tapered section to said tip section;

the lower section further including a reverse taper section extending from the upper end of the first tapered section toward said butt end of the shaft and to the upper end of the lower section;

an upper section extending from said butt end of the shaft towards the lower section and including a grip section at said butt end, formed to be gripped by a golf player;

said upper section tapering in a direction away from said butt end of the shaft at a substantially constant second taper per unit length from said grip section to the upper end of said lower section; and wherein the first taper per unit length of the first tapered section is greater than the second taper per unit length of the upper section so that the stiffness of the lower section is greater than the stiffness of the upper section.

2. The golf club shaft of claim 1, wherein the lower section of the shaft is located in the lower third of the shaft.

3. The golf club shaft of claim 1, wherein the first taper per unit length of the first tapered section is on the order of twice as much as the second taper per unit length of the upper section.

4. The golf club shaft of claim 1, wherein the first taper per unit length of the first tapered section is more than twice as much as the second taper per unit length of the upper section.

5. The golf club shaft of claim 1, wherein the reverse taper section is shorter in length than the first tapered section.

6. The golf club shaft of claim 1, wherein the shaft is formed of graphite material.

7. The golf club shaft of claim 1, wherein said shaft is formed of composite material.

8. The golf club shaft of claim 1, wherein said shaft is formed of steel.

9. The golf club shaft of claim 1, wherein the tip section has a constant diameter.

10. The golf club shaft of claim 1 wherein:

said first tapered section has a first diameter value D1 at a distance $l_1$ from the upper end thereof and a second diameter value D2 at the upper end thereof;

said upper section further has a third diameter value D3 at the upper end of the lower section and a fourth diameter value D4 spaced therefrom by a distance $l_2$, where the distance $l_2$ is equal to the distance $l_1$; and the relationship between the first taper per unit length of the first tapered section and the second taper per unit length of the upper section is $$\frac{(D2 - D1)}{(D4 - D3)} \geq 2.$$

11. A set of at least two golf club shafts, where the length of each shaft, from a tip end to a butt end decreases along said set, and each shaft comprising:

a tip section including said tip end for receiving a golf club head;

a lower section having an upper end and a first tapered section tapering in a direction toward said tip section at a substantially constant first taper per unit length from an upper end of said first tapered section to said tip section;

the lower section further including a reverse taper section extending from the upper end of the first tapered section toward said butt end of the shaft and to the upper end of the lower section, said reverse taper section being spaced from the tip end of the shaft by a predetermined distance;

an upper section extending from said butt end of the shaft towards the lower section and including a grip section at said butt end, formed to be gripped by a golf player;

said upper section tapering in a direction away from said butt end of the shaft at a substantially constant second taper per unit length from said grip section to the upper end of said lower section;

the first taper per unit length of the first tapered section is greater than the second taper per unit length of the upper section so that the stiffness of the lower section is greater than the stiffness of the upper section; and the predetermined distance varies with respect to each other shaft of said set.

12. The set of claim 11, wherein the predetermined distance decreases with respect to each shaft of the set along the set as the shaft length along the set decreases.

13. The set of claim 11, wherein said shafts are formed of composite material.

14. The set of claim 11, wherein said shafts are formed of steel.

* * * * *